US007647896B2

(12) United States Patent
Isopo

(10) Patent No.: US 7,647,896 B2
(45) Date of Patent: Jan. 19, 2010

(54) CENTRIFUGAL ROTARY DEVICE FOR HEATING AND/OR VAPORIZING LIQUIDS

(76) Inventor: Cristian Isopo, Via Catullo, 91b, Pomezia, (RM) (IT) I-00040

( * ) Notice: Subject to any disclaimer, the term of this patent is extended or adjusted under 35 U.S.C. 154(b) by 320 days.

(21) Appl. No.: 11/571,105

(22) PCT Filed: Jul. 22, 2005

(86) PCT No.: PCT/IT2005/000428

§ 371 (c)(1),
(2), (4) Date: Dec. 21, 2006

(87) PCT Pub. No.: WO2006/011176

PCT Pub. Date: Feb. 2, 2006

(65) Prior Publication Data

US 2008/0060588 A1 Mar. 13, 2008

(30) Foreign Application Priority Data

Jul. 28, 2004 (IT) ..... RM2004A0382

(51) Int. Cl.
*F22B 3/06* (2006.01)

(52) U.S. Cl. ..... 122/26; 126/247

(58) Field of Classification Search ..... 122/26; 126/247; 237/12.3, 12.3 R, 12.3 B
See application file for complete search history.

(56) References Cited

U.S. PATENT DOCUMENTS 3,791,167 A * 2/1974 Eskeli ..... 62/401
3,791,349 A * 2/1974 Schaefer ..... 122/11
5,913,306 A * 6/1999 Moroi et al. ..... 126/247
6,187,237 B1 * 2/2001 Kirjavainen et al. .... 264/173.16
6,959,669 B2 * 11/2005 Thoma ..... 122/26
7,387,262 B2 * 6/2008 Thoma ..... 237/12.3 R
2004/0194775 A1 * 10/2004 Thoma ..... 126/247
2005/0074341 A1 * 4/2005 Dairokuno et al. ..... 417/410.1

FOREIGN PATENT DOCUMENTS

JP 2002-031409 1/2002

* cited by examiner

*Primary Examiner*—Gregory A Wilson
(74) *Attorney, Agent, or Firm*—Lucas & Mercanti, LLP

(57) ABSTRACT

The centrifugal rotary device for heating and/or vaporizing liquids comprises a casing (1) within which is positioned a truncated conical chamber (12) having an inlet orifice (18) through which a liquid, such as water, to be heated is introduced, and an outlet orifice (19) through which a heated liquid and/or vapor emerges. It comprises a pair of hollow truncated conical rotors (2, 3) positioned coaxially one inside the other, both being inside the truncated conical chamber (12), the inner rotor (3) of this pair being fixed to the end of a first drive shaft (30) passing through an aperture (17) formed in the major base (15) of the truncated conical chamber (12), while an outer rotor (2) of the pair if fixed to the end of a drive shaft (20) passing through an aperture (16) formed in the minor base (14) of the truncated conical chamber (12).

14 Claims, 2 Drawing Sheets

CENTRIFUGAL ROTARY DEVICE FOR HEATING AND/OR VAPORIZING LIQUIDS

The present invention relates to a centrifugal rotary device for heating and/or vaporizing liquids.

There are known rotary heaters which make use of the sliding friction created between surfaces located close together in relative movement.

U.S. Pat. No. 3,791,349 clearly explains how to produce a vapour generator having an expanded body of water subjected to shock waves in the form of water hammer which are repeated and intensified as the heat and pressure developed in the water convert the water into usable vapour. The expanded body of water is formed in an expanded chamber created between a fixed casing and a rotor inside the casing. The expanded chamber, in other words the chamber elongated in one direction only, is supplied with water. At least a first portion of the expanded chamber comprises a first passage with a closed end and at least a second portion of the chamber comprises a second passage which can be subjected to centrifugal force. When water is present in the expanded chamber, the rotation of the rotor creates shock waves in the body of water which is present in the expanded chamber, as a result of the centrifugal force acting in the second passage and the force due to the depressurization or vacuum formed in the first passage. The alternation of the centrifugal and depressurization forces, with the predominance of one force over the other, causes an increase of temperature and pressure in the body of water.

However, although the cited heater is capable of producing vapour, the flow of vapour produced is small because the body of water is highly expanded and is therefore thin.

An object of the present invention is to increase the quantity of water heated per unit of time.

Another object of the invention is to increase the efficiency of a heater of the cited type.

The above objects are achieved by subjecting a body of liquid, for example water, to shear forces in addition to the centrifugal force and the forces due to the depressurization or vacuum.

Therefore, according to the present invention, what is provided is a centrifugal rotary device for heating and/or vaporizing liquids, comprising a casing within which is positioned a truncated chamber having an inlet orifice, through which a liquid, such as water, to be heated is introduced, and an outlet orifice through which heated liquid and/or vapour emerges, the truncated conical chamber of the casing having a lateral surface, a major base and a minor base, and being provided with opposing coaxial apertures formed in the major and minor bases respectively, comprising a pair of hollow truncated conical rotors positioned coaxially one inside the other, with both rotors located inside the truncated conical chamber, this pair of rotors including an inner rotor, having corresponding head and shell portions, fixed to the end of a first drive shaft passing through the aperture formed in the major base of the truncated conical chamber, and an outer rotor, having corresponding head and shell portions, fixed to the end of a second drive shaft passing through the aperture formed in the minor base of the truncated conical chamber The present invention will now be described in relation to a preferred embodiment of the invention, it being understood that variations may be made in respect of construction without departure from the scope of protection of the present invention, reference being made to the figures of the attached drawing, in which:

Figure 1:
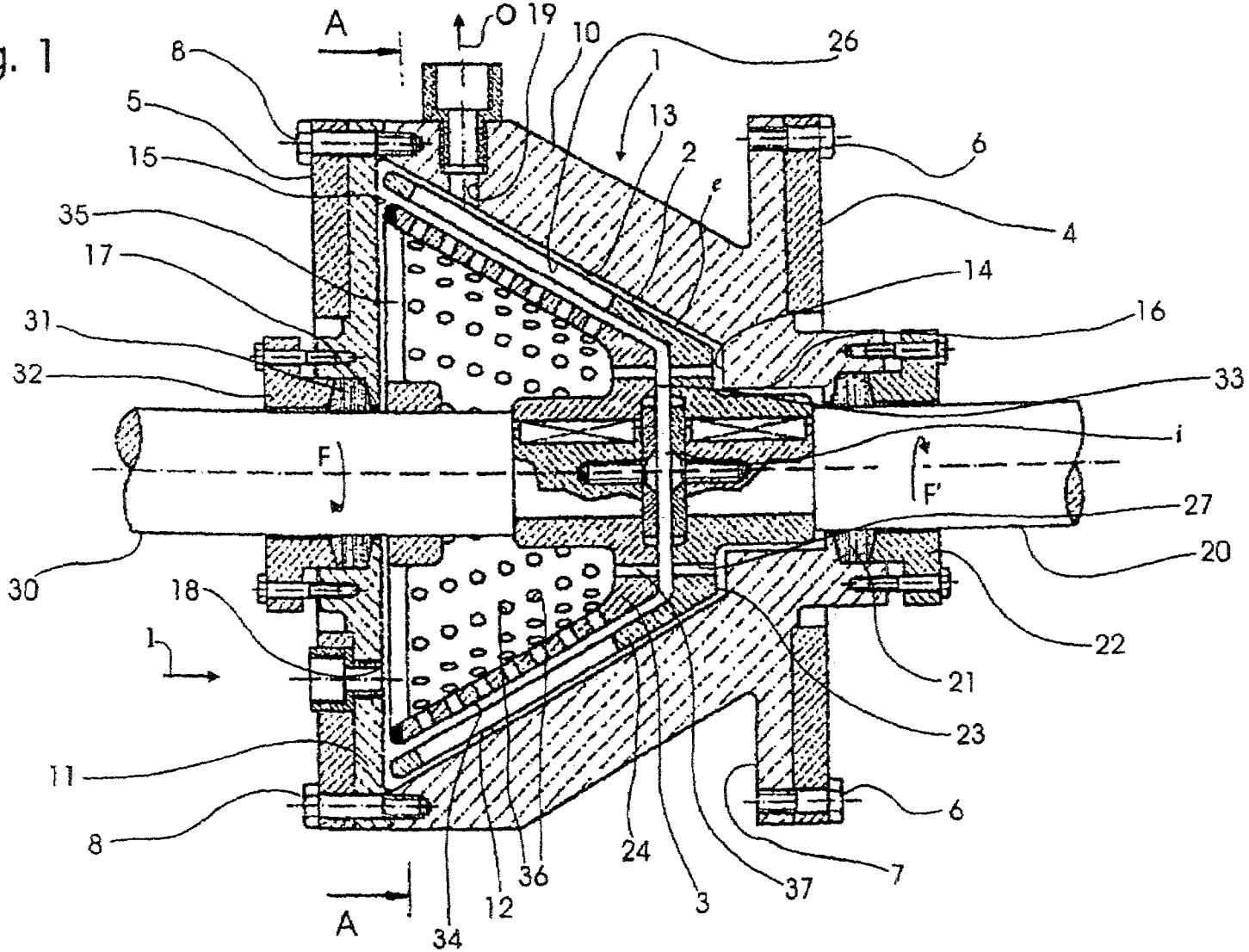
FIG. 1 shows a schematic axial longitudinal section, in partial section, through the rotary liquid heater according to the present invention.

With reference to the drawings, FIG. 1 shows, in an axial longitudinal section, the general appearance of the heater according to the invention. The heater has a casing indicated as a whole by 1, within which are an outer rotor 2 and an inner rotor 3 which are coaxially rotatable.

The casing 1 of the heater comprises a hollow truncated conical body 10 closed by an end plate 11. The hollow truncated conical body 10 and the end plate 11 delimit a truncated conical chamber 12. In particular, the hollow truncated conical body encloses the lateral surface 13 and the minor base 14 of the truncated conical chamber 12, while the end plate 11 closes the major base 15 of the said chamber 12.

An aperture 16 is formed in the hollow truncated conical body 10, in the minor base 14 of the chamber 12, while an aperture 17 is formed in the end plate 11, in other words in the major base 15 of the chamber 12. The apertures 16 and 17 are coaxial and are intended for the passage of corresponding shafts, as described below.

An inlet orifice 18 for the liquid to be heated, which enters through the corresponding connector in the direction of the arrow I, is also formed in the end plate 11. An orifice 19, for the outlet of the heated liquid or vapour in the direction shown by the arrow O, is formed in the hollow truncated conical body 10, on the lateral surface 13 of the chamber 12.

The heater is held in position on a base frame (not shown) by means of end brackets 4 and 5 positioned perpendicularly to the inner and outer rotor shafts. The end bracket 4 is conveniently connected by screws 6 to a flange 7 of the hollow truncated conical body 10, formed parallel to the minor base 14 of the truncated conical chamber 12. The other end bracket 5 is connected with screws 8 both to the end plate 11 and to the hollow truncated conical body 10 of the casing.

A shaft 20 passes into the aperture 16 of the hollow truncated conical body 10. The aperture 16 is suitably extended by the flange 7 to enable a sealing gasket 21 to be fitted around the shaft 20 and to be retained by a packing gland 22. The outer rotor 2, which has a head 23 and a shell 24 creating a hollow truncated conical shape matching the lateral surface 13 and the minor base 14 of the truncated conical chamber 12 of the hollow truncated conical body 10, is fixed to one end of the shaft 20 which passes into the aperture 16. As shown by way of example, the rotor is fixed to the shaft by means of a screw and key to prevent the rotation of the rotor with respect to the shaft. The outer rotor 2 is positioned with respect to the hollow truncated conical body 10 in such a way that the head 23 and the shell 24 are separated from the lateral surface 13 and the minor base 14 of the truncated conical chamber 12 by substantially the same interspace e. It has been found that, if the liquid to be heated is water, the size of this interspace is preferably approximately 3 mm for certain heating applications. The characteristics of the outer rotor 2 are described below.

A shaft 30 passes into the aperture 17 of the end plate 11. The end plate 11 is suitably thickened around the aperture 17 to enable a sealing gasket 31 to be housed around the shaft 30 and retained by a packing gland 32. The inner rotor 3, which has a head 33 and a shell 34 creating a hollow truncated conical shape matching the lateral surface 13 and the minor base 14 of the truncated conical chamber 12 of the hollow truncated conical body 10, is fixed to one end of the shaft 30 inside the truncated conical chamber 12. The inner rotor 3 is positioned inside the outer rotor 2 in such a way that the head 33 and the shell 34 of the inner rotor 3 are separated from the head 23 and the shell 24 of the outer rotor substantially by the interspace distance i which is substantially equal to the interspace e found between the outer rotor 2 and the hollow truncated conical body 10. Clearly, the arrangement of the outer and inner rotors is such that the corresponding shafts extend on opposite sides of the fixing ends of the corresponding rotors. The inner rotor 3 also has spokes 35 for centring on the shaft 30.

Figure 2:
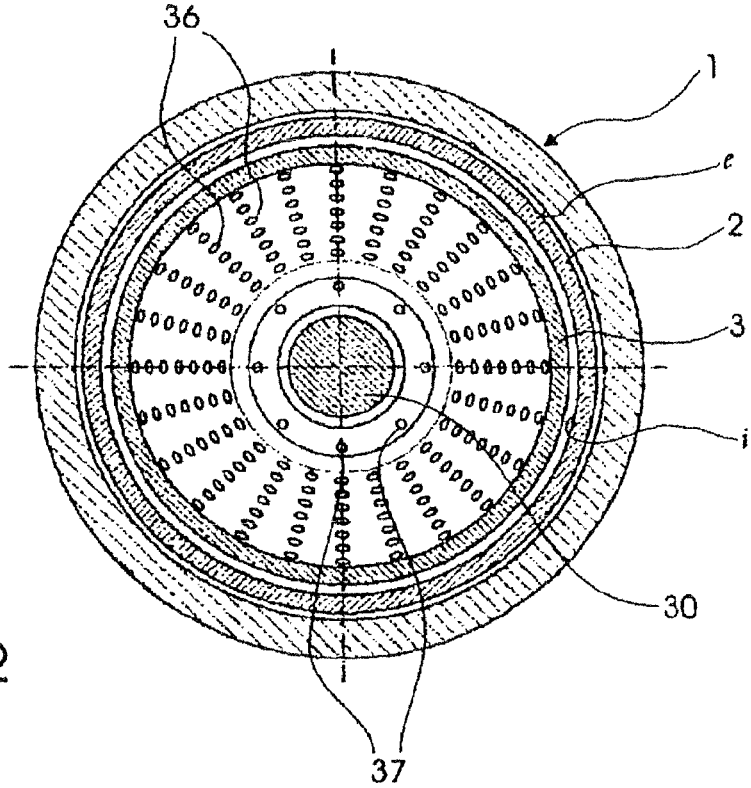
FIG. 2 shows a section taken along a plane A-A of FIG. 1.
Figure 3:
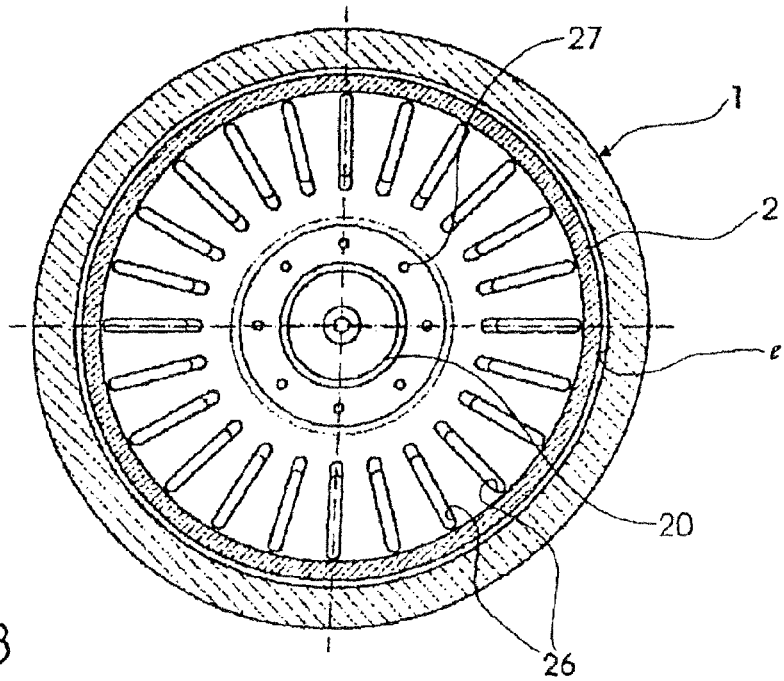
FIG. 3 shows a section taken along a plane A-A of FIG. 1, after the removal of the inner rotor from the rotary heater.

The inner rotor 3 is provided with a plurality of through holes 36 in its shell portion 34. The outer rotor 2 is provided with a plurality of through holes 26 in its shell portion 24. The outer and inner rotors 2 and 3 also have a plurality of axial through holes 27, 37 in their respective head portions 23 and 33. The shape of the rotors, with their holes and slots, is shown more clearly in FIGS. 2 and 3. Both of these figures are sections taken through the plane A-A of FIG. 1. In particular, FIG. 3 is a view without the inner rotor 3.

Although this is not shown in the figures, the lateral surface 13 of the truncated conical chamber 12 preferably has facing axial grooves.

The rotors are preferably mounted on the corresponding shafts with an interspace preferably equal to approximately 3 mm between the inner rotor and the outer rotor and between the outer rotor and the casing.

Additionally, in a variant of the present invention which is not shown, the fixed or movable surface of the elements immersed in the liquid or in contact with it in any way can be provided with protuberances, projections and/or shaped elements in order to increase turbulence inside the device, thus creating vortices and water hammer.

The operation of the heater according to the present invention is explained in the following text.

The water or other liquid is introduced into the truncated conical chamber 12 through the orifice 18. The water pressure is adequate, being 200 kPa for example. In standard operating conditions, with maximum efficiency, the truncated conical chamber 12 is completely filled with water. The rotors are counter-rotating, since, as shown in FIG. 1, the shaft 20 of the outer rotor 2 is rotated in the direction indicated by the arrow F' (by means of a motor which is not shown), while the shaft 30 of the inner rotor 3 is rotated in the opposite direction indicated by the arrow F (by means of a motor which is not shown).

The rotary movement of the inner rotor 3 imparts a centrifugal action to the water which is propelled outwards so that it passes through the holes 36 of the inner rotor into the interspace i between the inner rotor 3 and the outer rotor 2. The outer rotor 2 has slots 26 through which the water passes from the interspace i to the interspace e. Since the rotor 2 rotates in the opposite direction to the rotor 3, the water is subjected to a shear effect. In the interspace e the water is subjected to a tangential shear effect with respect to the surface of the truncated conical chamber. These successive effects, namely the centrifugal effect, the effect of drawing through the holes and slots, the tangential shear effect and also the effect of depressurization in the through holes 37 and 27 of the heads 33 and 23, including water hammer, cause an increase in the pressure and temperature of the water which flows out through the nozzle 19 in the direction of the arrow O.

By using two hollow counter-rotating rotors fitted in the truncated conical chamber, efficient heating is achieved, up to the change of state of the water.

The centrifugal rotary device for heating and/or vaporizing liquids according to the present invention can be used for pasteurizing and/or homogenizing milk or other emulsions, for pasteurizing wine and other liquid food products, for mixing petrochemicals, and similar processes.

By comparison with prior art heaters, the process using the device according to the present invention is faster, and enables greater quantities of vapour to be produced.

The invention claimed is:

1. Centrifugal rotary device for heating and/or vaporizing liquids, comprising a casing within which is positioned a truncated chamber having an inlet orifice, through which a liquid to be heated is introduced, and an outlet orifice through which heated liquid and/or vapour emerges, the truncated conical chamber of the casing having a lateral surface, a major base and a minor base, and being provided with opposing coaxial apertures formed in the major and minor bases respectively, and comprising a pair of hollow truncated conical rotors positioned coaxially one inside the other, with both rotors located inside the truncated conical chamber, this pair of rotors including an inner rotor adapted to rotate in a first rotation direction, having corresponding head and shell portions, fixed to the end of a first drive shaft passing through the aperture formed in the major base of the truncated conical chamber, and an outer rotor adapted to rotate in a second rotation direction opposite to said first rotation direction, having corresponding head and shell portions, fixed to the end of a second drive shaft passing through the aperture formed in the minor base of the truncated conical chamber.

2. Centrifugal rotary device according to claim 1, characterized in that the inner rotor is provided with a plurality of through holes in its shell portion.

3. Centrifugal rotary device according to claim 1, characterized in that the outer rotor is provided with a plurality of axially directed through slots in its shell portion.

4. Rotary device according to claim 1, characterized in that each of the head portions of the inner and outer rotors has a plurality of axial through holes.

5. Rotary device according to claim 1, characterized in that the fixed or movable surfaces of the elements immersed in the liquid or in contact with it have protuberances, projections and/or shaped elements provided on them, in order to increase the turbulence inside the device, thus creating vortices and water hammer.

6. Rotary device according to claim 1, characterized in that the lateral surface of the truncated conical chamber of the casing has axial grooves facing the shell portion of the outer rotor.

7. Rotary device according to claim 1, characterized in that the inlet orifice passes through the minor base of the truncated conical chamber of the casing.

8. Rotary device according to claim 1, characterized in that the outlet orifice passes through the lateral surface of the truncated conical chamber of the casing.

9. Rotary device according to claim 1, characterized in that the rotors are mounted on the corresponding shafts with an interspace preferably equal to approximately 3 mm between the inner rotor and the outer rotor and between the outer rotor and the casing.

10. Rotary device according to claim 1, characterized in that casing comprises a hollow truncated conical body, which surrounds the lateral surface and the minor base of the truncated conical chamber and has, in the proximity of the minor base aperture, a sealing gasket which surrounds the drive shaft of the outer rotor, and is retained by a packing gland.

11. Rotary device according to claim 10, characterized in that the hollow truncated conical body has a flange extending from its portion which surrounds the minor base of the truncated conical chamber.

12. Rotary device according to claim 1, characterized in that the casing comprises an end plate delimiting the major base of the truncated conical chamber, and has, in the proximity of the major base aperture, a sealing gasket which surrounds the drive shaft of the inner rotor, and is retained by a packing gland.

13. Rotary device according to claim 1, characterized in that a heater is held in position by means of end brackets positioned perpendicularly to the shafts of the inner and outer rotors.

14. Rotary device according to claim 13, characterized in that one end bracket is connected with screws to the said flange of the hollow truncated conical body and the other end bracket is connected with screws both to the end plate and to the hollow truncated conical body of the casing.

* * * * *